United States Patent [19]

Difley et al.

[11] 4,068,575

[45] Jan. 17, 1978

[54] REFUSE COMPACTOR WITH SELECTIVE SPRAY DEVICE

[75] Inventors: Charles R. Difley, Danville; Milton J. Johnson, Stanford; William R. McDonald, Danville, all of Ky.

[73] Assignee: Whirlpool Corporation, Benton Harbor, Mich.

[21] Appl. No.: 717,368

[22] Filed: Aug. 24, 1976

[51] Int. Cl.[2] ..... B30B 15/30

[52] U.S. Cl. ..... 100/45; 100/73; 100/229 A; 222/180; 239/274; 312/31; 312/211; 21/77

[58] Field of Search ..... 100/45, 73, 71, 72, 100/74, 75, 229 A; 312/31, 211, 31.2, 31.3, 330; 222/180, 402.5; 53/124 B; 141/71, 73; 239/274; 21/77

[56] References Cited

U.S. PATENT DOCUMENTS

| | | | |
|---|---|---|---|
| 2,989,214 | 6/1961 | Manheimer | 222/180 |
| 3,556,619 | 1/1971 | Bottas | 312/31 |
| 3,636,862 | 1/1972 | Bottas | 100/45 |
| 3,793,942 | 2/1974 | Martiniak | 100/73 |
| 3,800,694 | 4/1974 | Miller | 100/45 |
| 3,821,927 | 7/1974 | Stratman | 100/73 |
| 3,839,952 | 10/1974 | McDonald | 100/45 |

*Primary Examiner*—Billy J. Wilhite

*Attorney, Agent, or Firm*—Wegner, Stellman, McCord, Wiles & Wood

[57] ABSTRACT

A selective spray device for use in a refuse compactor, or the like, arranged to provide selectively onto the refuse a deodorizing spray. The device includes a control for effecting automatically a spray of the refuse as an incident of movement of the receptacle into which the refuse is placed for compaction. A manually operable control permits a manual operation of the spray device when desired at any time. The control may further be arranged to prevent operation of the spray device notwithstanding movement of the receptacle. The spray may be provided as a pressurized fluid in a can having a suitable selectively operable valve. The valve actuator may be held fixed while the can itself is displaced to effect an opening of the valve. The control may include a slidable cam having associated therewith a manually operable handle. The selective opening of the valve may be effected by a lever pivotally mounted adjacent the cam and having a cam follower engaged by the cam.

14 Claims, 8 Drawing Figures

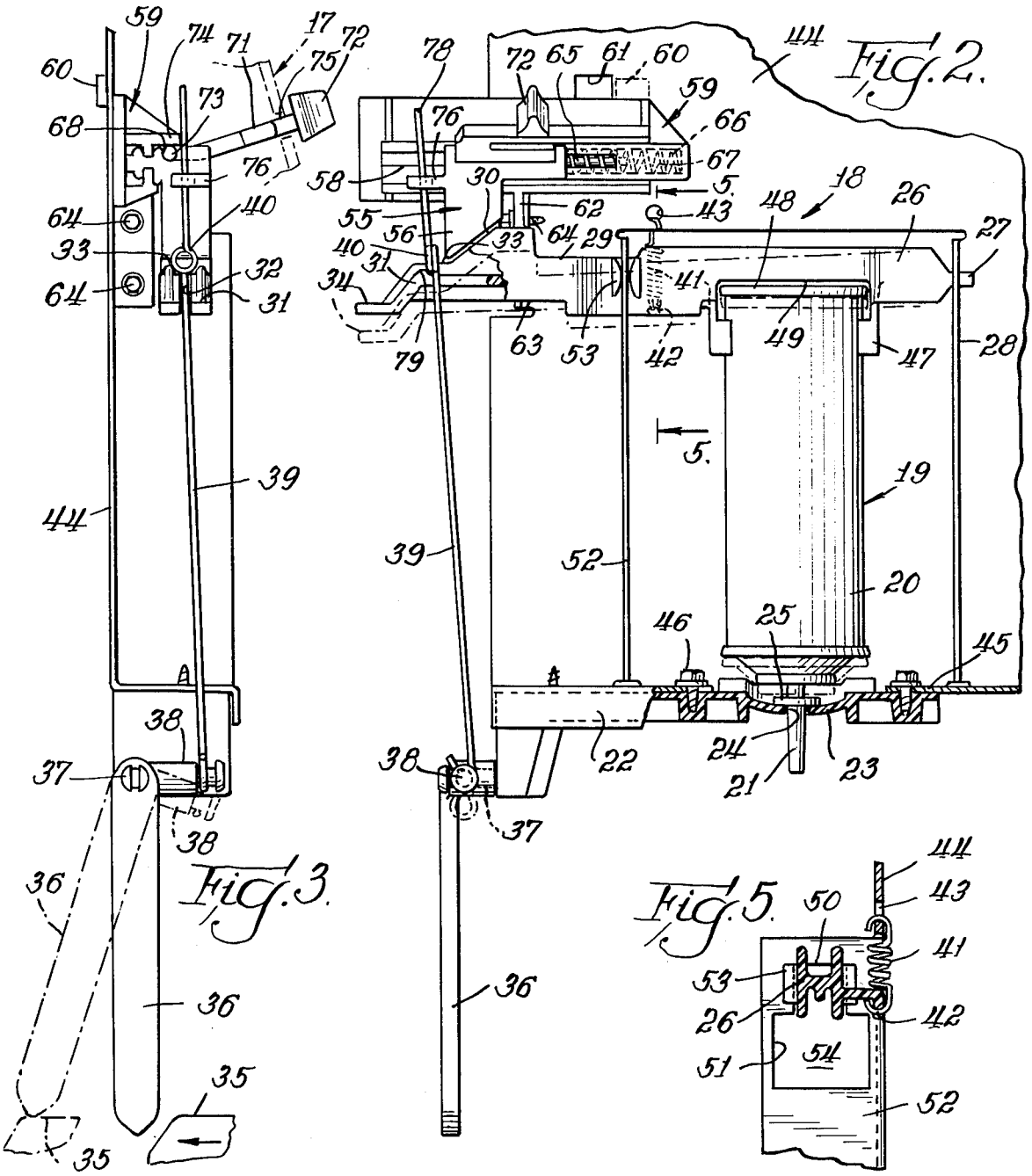
Fig. 2.
Fig. 3.
Fig. 5.
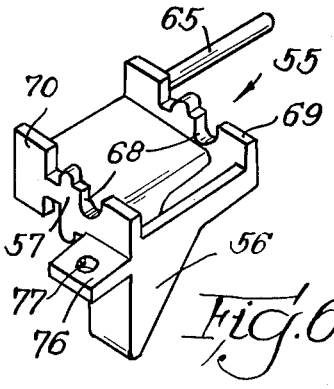
Fig. 6.
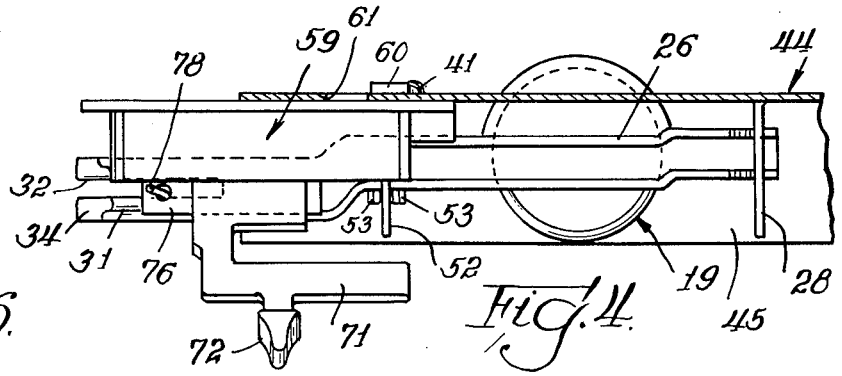
Fig. 4.

REFUSE COMPACTOR WITH SELECTIVE SPRAY DEVICE

BACKGROUND OF THE INVENTION

1. Field of the Invention

This invention relates to spray devices and in particular to spray devices for use in providing deodorizing sprays in refuse compactors and the like.

2. Description of the Prior Art

To provide improved efficiency in the handling of refuse and the like, improved refuse compactors have recently been developed wherein refuse is collected in a drawer-type receptacle and compacted therein. Such compaction of the refuse permits a large quantity of refuse to be accomulated for facilitated handling and disposal.

It has been found, however, desirable to provide some deodorizing means because of the increased duration of storage of the refuse prior to the necessary thereof. Thus, as shown in U.S. Pat. No. 3,556,619 of Michael J. Bottas et al which patent is owned by the assignee hereof a refuse storage apparatus is provided with means for spraying the refuse when the drawer is returned to the storage position. The spraying mechanism may include a cam means on the drawer for operating an arm associated with the spraying mechanism.

In U.S. Pat. No. 3,636,862 of Michael J. Bottas et al which patent is also owned by the assignee hereof, an improved form of refuse compactor spray device is shown wherein the spray device is arranged to provide a measured amount of spray irrespective of the rate of movement of the drawer. Additionally, the drawer camming means may be arranged to provide a plurality of sprays depending on the amount of movement of the drawer.

Frank E. Miller et al, in U.S. Pat. No. 3,800,694, owned by the assignee hereof, disclose an improved refuse compactor spray means wherein the mounting elements are arranged in a coordinated relationship, providing improved accuracy in the mounting arrangement while yet comprising a low cost, simple construction.

In U.S. Pat. No. 3,839,952, of William Roy McDonald et al, which patent is also owned by the assignee hereof, a refuse compactor is provided with a selective spray device which is manually operable for selecting a desired mode of operation. The control mechanism may be biased to an arrangement wherein the spray means is automatically operated and the selector mechanism may be disposed to prevent treatment of the refuse irrespective of movement of the receptacle. A manual mode of operation is provided wherein manipulation of the control mechanism provides a spray onto the refuse. The control comprises a rotary mechanism is operated by rotation of a control knob extending forwardly through a front panel of the compactor.

George J. Manheimer, in U.S. Pat. No. 2,989,214, shows an automatic aerosol dispensing device which is operated by the closing of a door for spraying insecticides, mothproofing ingredients, or deodorizers from an aerosol cartridge provided with a metering nozzle.

In U.S. Pat. No. 3,793,942 of Leonard J. Martiniak et al, a manually operable device is provided for controlling a spray valve of a deodorant or disinfectant aerosol container.

Jerome F. Stratman et al, in U.S. Pat. 3,821,927, show a refuse compactor control system wherein the spray is effected by a manually operated solenoid actuator for causing the spray to be discharged into the receptacle while in its inner storage and compacting position.

SUMMARY OF THE INVENTION

The present invention comprehends an improved refuse deodorizing means for in a refuse compactor, or the like, which is extremely simple and economical of construction.

The spray control mechanism of the present invention provides improved reliability with effectively minimum criticality in the adjustment of the actuation mechanism.

The different modes of operation provided by the control of the present invention may be effected independently of each other for further improved facility.

The invention further comprehends an improved method of effecting the spraying of refuse from a pressurized spray can wherein the discharge valve is maintained fixed and the can body is suitably moved to effect an opening of the valve. In the illustrated embodiment, the can body is pivoted by a pivotally mounted lever engaging the can body to effect the desired valve opening operation.

In the illustrated embodiment, the control is positionable by means of a manual operating handle which is movable in a preselectd rectilinear path for selectively positioning an associated cam and providing the desired different modes of operation of the deodorizing means.

Thus, the refuse compactor deodorizing means of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein:

FIG. 2 is a fragmentary enlarged vertical section taken substantially along the line 2—2 of FIG. 1 illustrating in greater detail the deodorizing means;

FIG. 3 is a left side elevation thereof;

FIG. 4 is a fragmentary top plan view thereof;

FIG. 5 is a fragmentary vertical section taken substantially along the line 5—5 of FIG. 2;

FIG. 6 is a perspective view of the cam member of the deodorizing means;

DESCRIPTION OF THE PREFERRED EMBODIMENT

Figure 1:
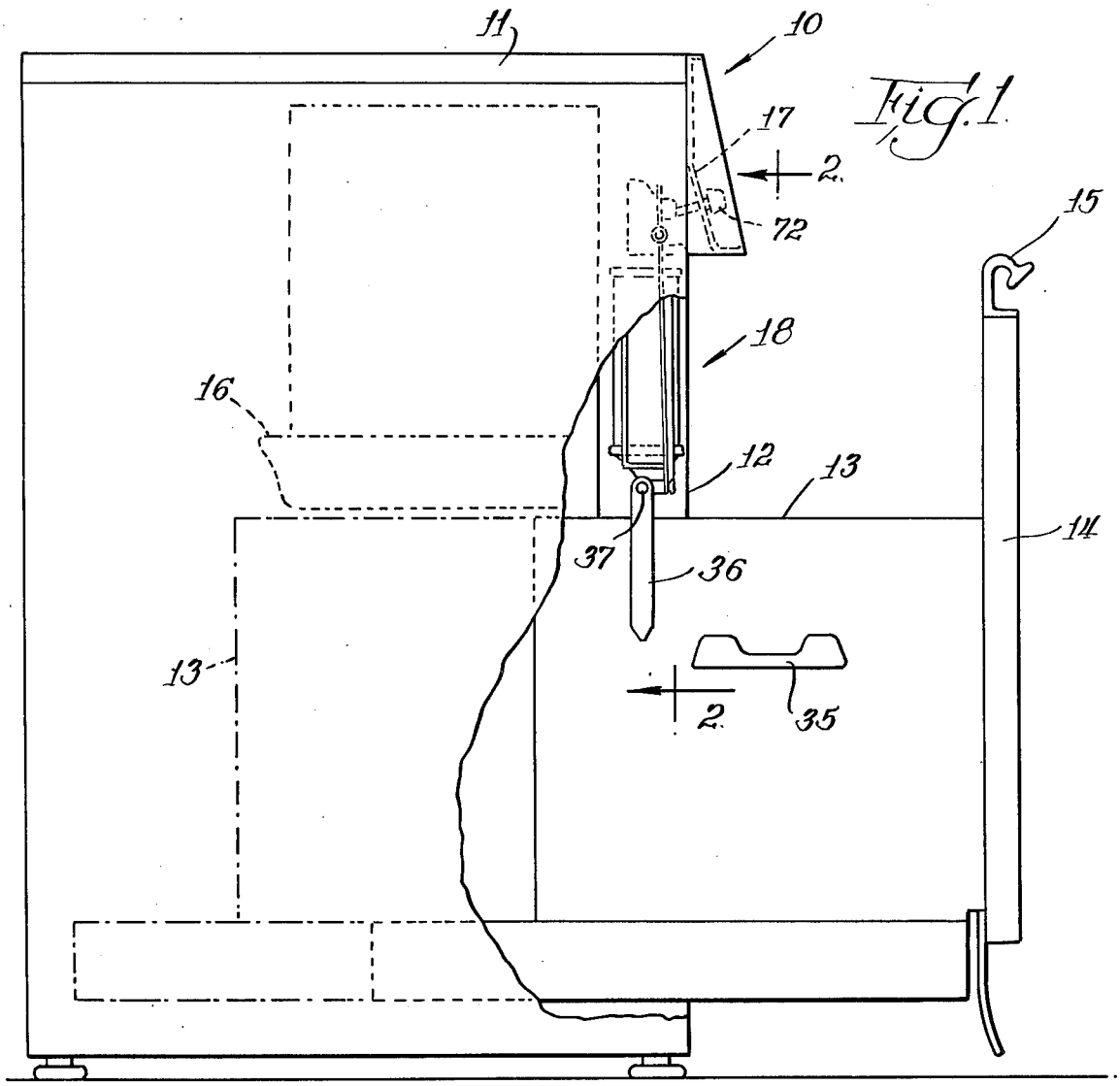
FIG. 1 is a side elevation of a refuse compactor with a portion broken away to facilitate illustration of the deodorizing means mounted therein, embodying the invention.

In the exemplary embodiment of the invention as disclosed in the drawing, a refuse compactor generally designated 10 is provided with a cabinet 11 defining a front opening 12 through which is selectively positionable a drawer-type receptacle 13 having a front 14 provided with a handle 15. As shown in FIG. 1, the drawer may be moved forwardly to an exposed position wherein refuse may be placed in the drawer for subsequent compaction. Compaction is effected by means of a ram 16 which is movable downwardly into the drawer 13 when the drawer is moved into the cabinet 11 to the dotted line position of FIG. 1 wherein the drawer is disposed subjacent the ram.

Cabinet 11 further defines a control panel 17 which may be disposed on the front of the cabinet 11 above the drawer front panel 14.

As indicated briefly above, it is desirable to provide deodorizing spray or other refuse treating spray onto the refuse in the drawer 13 from time to time for improving retention of a substantial quantity of refuse in the compactor drawer. In the present compactor structure, the deodorizing means generally designated 18 is arranged to deliver the deodorizing spray from a pressurized container, or can, 19 having a body 20 and a discharge nozzle 21 mounted on the discharge valve stem 20'.

Nozzle 21 is supported on a carrier plate 22 having a concave midportion 23 provided with an opening 24 downwardly through which the discharge nozzle 21 extends. Nozzle 21 includes a collar 25 which rests on the upper surface of the carrier wall portion 23. Opening of the discharge valve not shown is effected by an inward movement of the nozzle 21 and therefore valve stem 20' relative to the can body. In the present invention, the nozzle is supported by the carrier wall portion 23 and the can body 20 is moved downwardly to effect the valve opening operation of valve stem 20'.

More specifically, downward movement of can body 20 is effected by a counterclockwise pivoting of a lever 26, as shown in FIG. 2, having an end portion 27 pivotally mounted to a support 28 defining a portion of the frame of the compactor.

Figure 8:
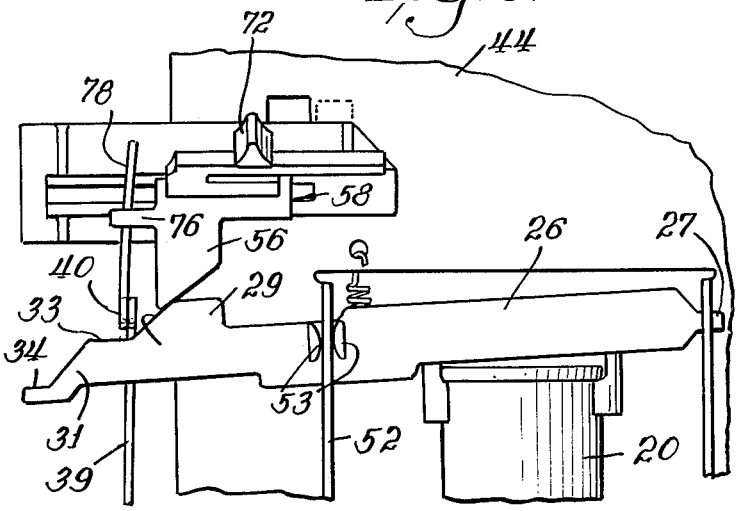
FIG. 8 is a fragmentary front elevation illustrating the arrangement of the control in the "manual" mode of operation.

As best seen in FIGS. 2 and 8, lever 26 further defines at its opposite end 29 a cam follower surface 30. Outwardly of surface 30, the lever end 29 a bifurcated distal portion 31 having a central slot 32. Bifurcated portion 31 further defines an inner, upper surface 33 and a distal, lower outer surface 34.

As indicated briefly above, the deodorizing means 18 of the present invention may be operated in any of three different modes including an "automatic" mode, a "manual" mode, and a "none" mode. In the "automatic" mode, a suitable downward movement of spray can body 20 is effected as an incident of the movement of drawer 13 from the open position to the closed position as after the introduction of additional refuse. To effect such "automatic" operation, the drawer is provided with an operator member 35 adapted to engage a pivot arm 36 carried on a suitable pivot 37 by the movement of the operator 35 into engagement with the lower end of the arm 36. As best seen in FIG. 3, the pivot arm 36 further includes a forwardly projecting post portion 38 which is swung downwardly as a result of rearward pivoting of the arm 36 by the operator 35 as the drawer is moved from the exposed position shown in full lines in FIG. 1 to the compacting position shown in broken lines therein.

A wire connector 39 extends upwardly from post 38. The wire connector extends upwardly through slot 32 of the lever end portion 31 and is provided with a loop 40 engaging the upper surface 33 of lever end portion 31 in the "automatic" arrangement of the control. Thus, as illustrated in FIG. 3, a clockwise pivoting of the arm 36 causes a downward movement of connector 39 to effect a downward movement of lever portion 31, and as shown in FIG. 2, such downward movement of the lever portion 31 from the normal full line position thereof to the lower broken line position effects a downward pivoting of the lever 26 to urge the can body 20 downwardly and thereby effect an opening of the discharge valve by nozzle 21. The lever 26 may be biased upwardly to the full line position of FIG. 2 by a tension spring 41 connected between the connector portion 42 of the lever and a hole 43 in frame member 44. Support 28 may comprise a forwardly extending flange of frame member 44 and carrier 22 may be secured to a horizontal forwardly extending flange portion 45 of frame member 44 by suitable securing means, such as screws 46.

As best seen in FIG. 2, pivot 37 may comprise a distal end portion of the carrier 22.

Lever 26 may be provided with resilient fingers 47 for releasably engaging the can body 20 and retaining the upper portion 48 of the can body in a suitable recess 49 of the lever to provide the desired selective positioning of the can body 20 in the full and broken line positions illustrated in FIG. 2.

The upward movement of the can body 20 and clockwise pivoting of lever 26, as seen in FIG. 2, is limited by the abutment of the lever with the upper edge 50 of an opening 51 in a second vertical forwardly extending flange 52 of the frame member 44. Lever 26 may be provided with suitable guides 53 for slidably engaging the flange 52 and effectively retaining the lever against longitudinal displacement. As shown in FIG. 5, the opening may include an enlarged lower portion 54 for facilitated installation of the lever 26 therethrough.

The present invention, as indicated briefly above, provides for a "manual" operation of the spray means when desired. To effect such "manual" operation, a cam member 55 is provided having a cam portion 56 and a slide portion 57. Slide portion 57 is slidably received in a slot 58 of a slide carrier 59 carried on frame member 44 by means of a tab 60 insertable through an opening 61 in the frame member 44, and a tab 62 secured to a turned flange 63 of the frame member 44 by suitable means, such as screws 64.

As shown in FIG. 6, the cam member further includes a spring guide 65. The spring guide projects into a recess 66 in slide carrier 59 coaxially carrying a helical spring 67 for biasing cam member 55 to the left, as seen in FIG. 2. Thus, as shown therein, the cam portion 56 is normally biased away from the cam follower surface 30 of lever 26, permitting the above described normal "automatic" operation of the deodorizing means.

As shown in FIG. 6, the slide carrier is provided with a pair of aligned semicylindrical recesses 68 in opposite end walls 69 and 70 thereof. A handle member 71 provided with a handle manipulating portion 72 is further provided with a pair of oppositely projecting pivots 73 pivotally received in the recesses 68, as illustrated in FIG. 3. As further shown therein, slide carrier 59 is provided with a forwardly projecting flange 74 which overlies the pivots 73 to retain the handle member in the recesses. As further shown in FIG. 3, the control panel 17 is provided with a slot 75 through which the handle member 71 projects so as to dispose the manipulating portion 72 forwardly thereof for suitable manual operation by the user.

Thus, by movement of the manipulating portion 72 to the right, as seen in FIG. 2, cam portion 56 of the cam member 55 is urged against the cam follower surface 30 of the lever 26, and as a result of the angular arrangement of the cam follower surface 30, urges the lever pivotally in a counter-clockwise direction, as seen in FIG. 2, to move the cam body 20 downwardly and thereby effect an opening of the discharge valve 21 to provide manually controlled spraying of the refuse when desired.

As further shown in FIG. 6, the cam member 55 is further provided with a lug 76 having an opening 77 for receiving an outward extension 78 of the wire connector 39. When the manipulating member 72, is moved to the left, as seen in FIG. 2, the connecting member 39 is moved through the slot 32 correspondingly to the left until the loop 40 is disposed in overlying relationship to the lower surface 34 and, thus, spaced from the upper surface 33. Resultingly, a downward movement of the connector wire 39 will not effect a downward movement of the lever end 29, thereby preventing automatic operation of the sanitizing means by movement of the drawer 13 and effectively placing the deodorizing means in a "none" mode of operation. As there is no biasing means tending to restore the handle member 71 to the "automatic" position of FIG. 2, the control will remain in the "none" mode illustrated in FIG. 7 pending resetting of the control by the user.

Figure 7:
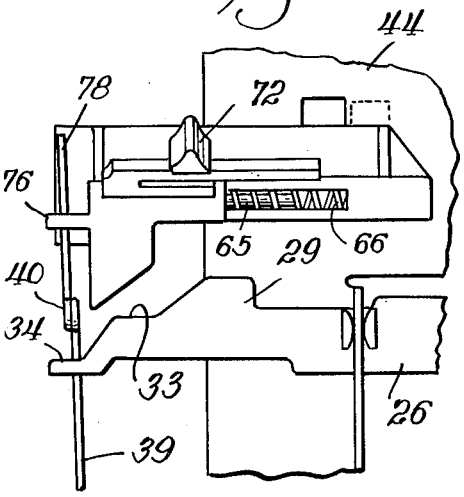
FIG. 7 is a fragmentary front elevation illustrating the arrangement of the control in the "none" mode.

As shown in FIG. 2, to prevent inadvertent movement of the control to the position of FIG. 7, lever end 29 may be further provided with a rounded shoulder portion 79 at the lefthand end of surface 33, thereby maintaining the loop 40 in overlying relationship to surface 33 in the absence of a positive movement of the cam member 55 to the left by manipulation of handle portion 72.

Thus, the present invention provides an improved deodorizing means for providing selective spray control of a pressurized can of deodorizing fluid. The control includes a slidably mounted cam selectively engaging a pivotable lever in turn engaging the supply can body to effect a desired control of the discharge valve. The position of the slidable cam determines the mode of operation of the apparatus. The control provides improved reliability and avoids the need for critical adjustment of the mechanism. While the refuse treating contents of aerosol can body 20 have been characterized as including a deodorizing ingredient, it is to be appreciated that a sanitizing, insecticide, or disinfectant ingredient or a combination thereof can be used as desired.

The foregoing disclosure of specific embodiments is illustrative of the broad inventive concepts comprehended by the invention.

Having described the invention, the embodiments of the invention in which an exclusive property or privilege is claimed are defined as follows:

1. In a refuse compactor having a receptacle for holding refuse, and means for movably carrying the receptacle for selective disposition in a refuse compacting position and in an exposed refuse receiving position, improved refuse treating means comprising: means for removably mounting above the receptacle a container of refuse treating material having a discharge valve and valve actuating means for selectively opening the valve to deliver refuse treating material from the container onto refuse in the receptacle; means for fixedly supporting the valve actuating means; and means for selectively moving the container relative to the fixedly supported valve actuating means to open the valve, said means for moving the container comprising means responsive to movement of said receptacle.

2. The refuse compactor structure of claim 1 wherein said means for moving the container comprises manually operable means.

3. In a refuse compactor having a receptacle for holding refuse, and means for movably carrying the receptacle for selective disposition in a refuse compacting position and in an exposed refuse receiving position, improved refuse treating means comprising: means for removably mounting above the receptacle a container of refuse treating material having a discharge valve and valve actuating means for selectively opening the valve to deliver refuse treating material from the container onto refuse in the receptacle; means for fixedly supporting the valve actuating means; and means for selectively moving the container relative to the fixedly supported valve actuating means to open the valve, said means for moving the container comprising control means selectively operable (a) to preclude movement of the container, and (b) to cause movement of the container as a result of movement of the container as a result of movement of the receptacle.

4. In a refuse compactor having a receptacle for holding refuse, and means for movably carrying the receptacle for selected disposition in a refuse compacting position and in an exposed refuse receiving position, improved refuse treating means comprising: means for removably mounting above the receptacle a container of refuse treating material having a discharge valve; valve actuating means including a cam follower for selectively opening the valve to deliver refuse treating material from the container onto refuse in the receptacle; and control means having an actuator means, and a slidably mounted, manually positionable cam means spaced from the receptacle for selectively causing the valve actuating means to open the valve (a) as an incident of movement of said receptacle to said compacting position, and (b) as a result of manual operation of the control means.

5. The refuse compactor structure of claim 4 wherein said cam means further comprises means for selectively preventing the actuator means from opening the valve as an incident of movement of said receptacle.

6. The refuse compactor structure of claim 4 wherein said control means includes means for guiding said means along a preselected substantially rectilinear path.

7. In a refuse compactor having a frame, a receptacle movably carried on said frame for holding refuse to be compacted, means for selectively providing access to the receptacle for placing refuse to be compacted therein, and means for treating the refuse in the receptacle including spray means for spraying a treating material onto refuse in the receptacle, improved control means for controlling operation of said spray means selectively (a) in an "automatic" mode to automatically treat the refuse as an incident of providing access to the receptacle, (b) in a "manual" mode to treat the refuse at any time as a result of a manual actuation of the control means, and (c) a "none" mode to prevent treatment of the refuse irrespective of providing access to the receptacle, said improved control means comprising: pivotally mounted lever means for operating the spray means as an incident of the pivoting of the lever means, said lever means carrying a cam follower; cam means slidably carried on said frame and manually operable to engage said cam follower to pivot said lever in said "manual" mode of operation; actuator means for pivoting said lever means in said "automatic" mode of operation as an incident of providing access to the receptacle; and means movable with said cam means for preventing pivoting of said lever means by said actuator means notwithstanding a providing of access to the receptacle in said "none" mode of operation.

8. The refuse compactor structure of claim 7 wherein a manipulatable handle is connected to said cam means for effecting selective manual movement of the cam means.

9. The refuse compactor structure of claim 7 wherein said cam means is selectively slidably positionable in the different positions corresponding to said "automatic," "manual," and "none" operation modes.

10. Apparatus for actuating the valve of a can of deodorizing spray fluid for spraying the deodorizing fluid onto refuse carried adjacent the can, said apparatus comprising: a lever; means for pivotally mounting the lever; cam means slidably mounted adjacent the lever; actuating means including a movable actuator; means for selectively engaging the actuator with a portion of the lever for pivoting the lever suitably to actuate the can valve as an incident of a preselected movement of the actuating means; and manually operable means for moving said cam means for selectively displacing the actuator from said portion of the lever to prevent pivoting of the lever and actuation of the can valve by said preselected movement of the actuating means.

11. The apparatus of claim 10 including a cam follower on said lever, said cam means being selectively movable to a preselected "manual" spray position whenever the cam means engages said cam follower to pivot said lever to actuate the can valve independently of said actuator.

12. The apparatus of claim 10 wherein said manually operable means comprises a handle.

13. The apparatus of claim 10 wherein said means cam is mounted for substantially rectilinear movement.

14. The apparatus of claim 10 wherein said lever defines a slot extending from said lever portion, and said movable actuator includes a portion extending through said slot for selective positioning by said cam means in different portions of the slot.

* * * * *